US005566473A

United States Patent [19]

Salminen

[11] Patent Number: 5,566,473

[45] Date of Patent: Oct. 22, 1996

[54] PROCESSING ROLL APPARATUS AND METHOD FOR WEB DRYING

[76] Inventor: Reijo K. Salminen, 373 Cove Rd., Bellingham, Wash. 98226

[21] Appl. No.: 315,911

[22] Filed: Sep. 30, 1994

Related U.S. Application Data

[63] Continuation-in-part of Ser. No. 291,115, Aug. 16, 1994.

[51] Int. Cl.[6] ..... F26B 3/00

[52] U.S. Cl. ..... 34/454; 34/119; 34/125

[58] Field of Search ..... 34/454, 602, 603, 34/317, 385, 414, 422, 520, 109, 119, 124–25, 132

[56] References Cited

U.S. PATENT DOCUMENTS

| | | | |
|---|---|---|---|
| 1,406,991 | 2/1922 | MacKay | 34/125 |
| 1,453,113 | 4/1923 | Hutchins | 34/125 |
| 1,623,017 | 3/1927 | Christoph | 34/128 |
| 3,914,875 | 10/1975 | Schiel | 34/454 |
| 3,948,283 | 4/1976 | Asfura et al. | 34/125 |
| 4,674,196 | 6/1987 | Means | 34/454 |
| 4,781,795 | 11/1988 | Miller | 34/119 |
| 4,933,073 | 6/1990 | Jonkers et al. | 34/109 |

*Primary Examiner*—John M. Sollecito
*Assistant Examiner*—Steve Gravini
*Attorney, Agent, or Firm*—Robert B. Hughes

[57] ABSTRACT

A processing roll adapted to engage paper or the like to heat and/or shape the same. The roll has a cylindrical side wall and defines a interior condensing chamber for steam. The interior surface of the roll is formed with longitudinal grooves which slope away from the longitudinal axis toward a central location. The steam condensates in the chamber, collects in the grooves, and flows toward a center location where the condensate is siphoned out and removed from the chamber. Improved heat transfer is achieved, and greater uniformity of heat is accomplished at the outside surface.

40 Claims, 12 Drawing Sheets

100
102
104
108
106
118
150
116
114
149
152
144
146
142
129
12A
146
128
126
148
152
110
112
14
15
118
150
106

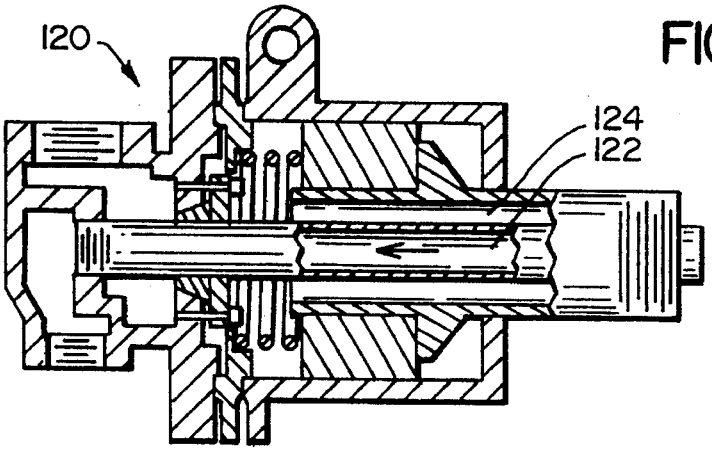
FIG. 16
FIG. 17
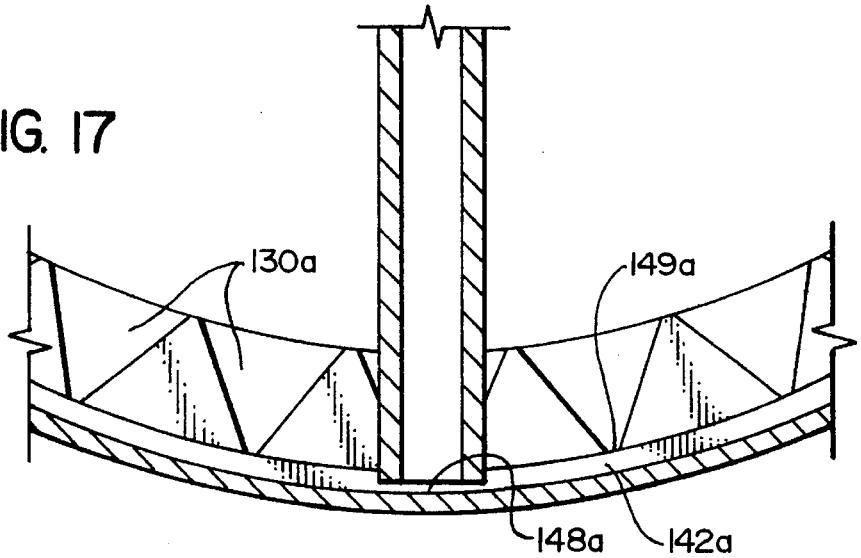
FIG. 18
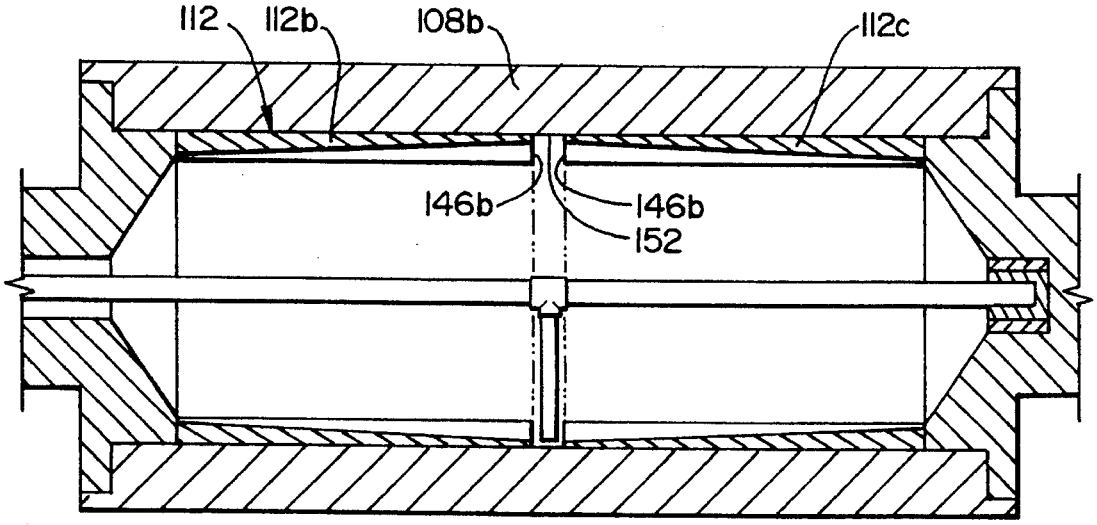

PROCESSING ROLL APPARATUS AND METHOD FOR WEB DRYING

CROSS REFERENCE TO RELATED APPLICATION(S)

This application is a continuation-in-part of the earlier filed U.S. application Ser. No. 08/291,115, filed Aug. 16, 1994.

FIELD OF THE INVENTION

This invention relates to a processing roll apparatus and method arranged to engage a material to be processed in heat exchange relationship, and more particularly to such an apparatus and method where the roll defines an enclosed chamber to contain a condensable heat transfer medium to transmit heat to the outside surface of the roll, such as a roll that is used in the pulp and paper industry to engage paper sheets and/or corrugating medium (i.e. a continuous web of paper formed into a corrugated shape) to heat and/or shape the same.

BACKGROUND OF THE INVENTION

There are various industrial applications where cylindrical rolls are used for such things as forming and/or drying sheet material, such as paper, pulp or corrugating medium. One specific application for such rolls is to form corrugated paper which is then bonded to upper and lower paper web to form a corrugated sandwich structure (cardboard). The exterior surface of the roll is made with longitudinally aligned ridges separated by recessed portions or grooves. The interior surface of the roll defines a closed chamber which is pressurized with a condensable heat transfer medium which is generally steam.

In operation pressurized steam is directed through an inlet which is commonly formed at an end wall of the roll with a rotary pressure seal, with the steam being at a temperature and pressure as high as possibly 400° F. and 200 pounds per square inch. As the steam condenses on the interior surface of the cylindrical side wall of the roll it transmits heat through the side wall and thus heats the paper or cardboard which is in contact with the roll side wall. As the steam condenses on the interior surface, the water is removed from the chamber by a siphon pipe or other removal mechanism and discharged through an outlet which can have a rotary seal joint.

A common arrangement for corrugating rolls is for a set of three rolls to be horizontally aligned, one above the other, with the elongate ridge portions of each roll fitting into the matching valley or recessed portions of the other roll. As these rolls are rotated, the paper or web is fed into the region between the rolls to have heat applied thereto and to be formed in a corrugated pattern. As the resulting corrugated sheet moves from the location between the rolls, it is then bonded to upper and lower paper web to form a corrugated sandwich structure.

By way of further background information, various heat transfer media for this type of rolls have been tried in the past, but substantially all cylinders or rolls used for heating, drying or forming pulp or paper are generally heated by steam condensing on the inner surface of the roll that defines a closed pressure chamber. However, there are possible alternatives to using steam, for example, organic vapors such as Dowtherm and special heat transfer oils. The heat transfer coefficient for film type condensation of steam on stationary surfaces ranges from one thousand to three thousand BTU/(hr) (square feet of surface) (°F.) difference in temperature between the steam and the surface being heated). The corresponding range for organic vapors is 200 to 300 and for oils 10 to 30.

Condensation is a constant temperature process, with the temperature depending upon the pressure. Because the internal volume of the roll is large compared with the rate of steam flow, the pressure is constant throughout. Thus, (provided there are no noncondensable gases) the heat leaves the steam at the same temperature at all points throughout the inner surface of the shell, thus, helping to maintain uniform heat transfer and drying at the water surface of the roll.

As the steam condenses on the interior surface of the roll, heat is transferred first from the steam to the condensate film, then through the film to the metal wall that forms the roll. If the steam is super heated, its temperature will drop before it condenses, but condensation will occur at the same temperature as though it had been saturated at the same pressure. Researchers have established that with about 180° F. super heat the rate of heat transfer to a given area is only about three percent more than for saturated steam at the same pressure.

The ideal steam supply and condensate removal system should supply pure steam (no noncondensables) and maintain a thin, uniform condensate film. If noncondensables are present, and if liquid condensate alone is discharged from the cylinder, the noncondensables accumulate. Since the presence of noncondensable gas reduce the heat transfer capacity and uniformity, special consideration should be given to insuring that the noncondensable gases are not allowed to accumulate. This can be accomplished in various ways. For example, by "blowing through" perhaps twenty percent of the steam supply with the condensate, a steam velocity high enough to purge noncondensables from the entire chamber within the roll can usually be achieved.

Certain special problems must be taken into account in applying well known heat transfer data and steam technology to steam heated rolls. Let t be assumed that the roll is stationary, pressurized steam is being fed into the roll, and a certain amount of condensate (liquid water) has formed and rests on the lower part of the interior surface.

As a roll begins to rotate, this tends to move the condensate in the direction of rotation of the roll; inertial forces tend to retard any change in motion of the condensate; centrifugal forces tend to hold the condensate against the inner periphery of the cylinder; and gravity tends to pull the condensate to the bottom of the cylinder. At very low speeds, the gravitational forces cause the condensate to run down the cylindrical side wall in a thin film that forms a puddle at the bottom of the roll. At slightly higher speeds, the viscous forces drag some of the condensate from the puddle part way up the ascending side wall of roll, but it continues to run down to the puddle. As the speed increases still further, the condensate is dragged higher up the interior surface of the side wall, and centrifugal forces hold the condensate to the side wall in the upper quadrant of the ascending side wall. However, gravity still prevails, and the condensate breaks away from the cylinder wall and "cascades" back to the bottom of the dryer.

The rimming condition is achieved when the centrifugal force becomes sufficiently greater than gravity, allowing the condensate to "go over the top". The speed at which this occurs is greatly dependant upon the amount of condensate present in the dryer, a thin layer being rimmed at a slower speed than a thicker layer. However, on the ascending and descending walls of the cylinder, gravity respectively decelerates and accelerates the condensate layer. This results in a condensate layer that is thickest at the top and thinnest at the bottom and in a relative motion of the condensate (with respect to the side wall) best described as "sloshing". At speeds just above the rimming speed, sloshing is considerable. As the speed is increased, the sloshing diminishes, until, at very high speeds, where the gravitational force is overwhelmed by the centrifugal force, sloshing becomes almost negligible.

Fluid flow within the roll has a marked effect on the heat transfer properties of the condensate. Under non-rimming conditions, droplets of condensations can form on the upper portions on the inner roll surface. With dropwise condensation there is no film, and droplets of condensate form and flow in rivulets in the puddle. There is much less resistance to heat transfer from the steam to the metal than with film condensation. The general requirement for dropwise condensation is a non-wettable surface.

Under rimming conditions, heat transfer is governed both by the thickness of the condensate and by fluid flow characteristics. The thinner the layer and more turbulent the flow, the less the resistance to heat transfer. Thickness of the condensate depends on the design, size, location and clearance of the siphon which extracts the condensate from the interior of the roll, roll speed and diameter, condensating rate and differential pressure. Turbulence depends on the condensate thickness and roll speed and diameter. Minimizing the condensate thickness, although resulting in a minimum of turbulence, will result in a lower resistance to, and greater uniformity of, heat transfer.

To illustrate one of the significant problems in operating such steam heated rolls, let us take the example of a paper corrugating operation where a quantity of paper is being fed between a set of two rolls. The steam in the rolls is at a predetermined pressure and temperature, and as indicated above, with the rolls being rotated at a sufficiently high speed, the condensate that has formed will reach a "rimming" condition where the liquid is distributed substantially uniformly (by centrifugal force) against the interior surface of the cylindrical side wall of the roll. In this condition, with the temperature within the roll being substantially uniform throughout and with heat transfer being substantially uniform through all areas of the cylindrical side wall, the 10 temperature of the outside surface of the cylindrical side wall is substantially uniform over the entire outer surface of the side wall.

However, let it now be assumed that it is desired to feed a different size or type of paper sheet through the corrugating rolls. It is necessary to stop the rolls, and it may take approximately five minutes or so (with the rolls being stationary to make the change over to feed the second paper material through the rolls. During this approximate five minute or so changeover time, the condensate (i.e. water) will have accumulated at the bottom part of the roll, and may reach a depth of, for example, ¼ inch or greater at the lowest point in the interior surface of the roll. Since liquid water is a relatively poor conductor of heat, that portion of the cylindrical wall of the roll that is beneath the liquid water that has accumulated in the bottom of the roll experiences a significant temperature drop in comparison with the other portions of the side wall of the roll (e.g. possibly several 10° F.). This uneven temperature will cause the roll to be distorted out of a perfectly round shape.

Thus, when the rolls are again starting to rotate, with the paper sheet being fed between the rolls, there will be substantial variations of the temperature at the side wall outer surface that engages the paper sheet. The result is that for a period of time (e.g. one to two minutes) until the surface temperature around the entire side wall surface of the roll becomes uniform, disturbing vibration of the roll will occur, the result being that this portion of the product must be discarded or run at a much lower speed. As the rolls continue to rotate and pick up speed, then the "rimming" occurs, and the temperature around the entire side wall again becomes substantially uniform so that the operation can be carried on in a suitable manner.

In addition to the problem noted above of obtaining substantial uniformity of surface temperature along the outside surface of the side wall of the roll, there is also the overall consideration of optimizing the heat transfer from the heat transfer medium (generally steam) within the roll to the outside surface. One avenue which has been explored extensively to accomplish this is to remove the condensate (i.e. liquid water) from the interior of the roll as effectively as possible so that the liquid film that accumulates on the interior surface of the roll during the rimming condition is as thin as possible. However, the overall problem of obtaining proper heat transfer is complex, and certain facets of this will be discussed later in this text.

It is with the above consideration and others in mind that the apparatus and method of the present invention has been developed.

SUMMARY OF THE INVENTION

The roll assembly of the present invention is designed to engage a material to be processed in heat transfer relationship, such as a sheet of paper or the like.

The roll assembly comprises a roll structure mounted for rotation and defines an enclosed chamber to contain a condensable heat transfer medium. The roll structure comprises a cylindrical side wall having an outside generally cylindrical contact surface to engage the material in heat transfer relationship and an inside generally cylindrical surface which is exposed to the heat exchange medium in the chamber in heat exchange relationship. The medium condenses on the inside surface and heat is conducted through the side wall to the outside surface. First and second end walls are located at first and second ends of the side walls.

The inside surface of the side wall is formed with a plurality of elongate ridges defining elongate valleys between each pair of adjacent ridges to receive condensate that condenses from the medium on the inner surface and provide flow paths for the condensate. The inside surface further provides a collecting location in communication with the valleys to receive the flow of the condensate along the flow paths.

There is condensate collecting means to collect the condensate from the collecting location. Also there is a chamber inlet means through which the medium passes into the chamber and chamber outlet means through which condensate of the medium passes from the chamber.

In the preferred form, the ridges and valleys are aligned with a longitudinal center axis of the roll structure about which the roll structure rotates. Also, the ridges and valleys are formed so that the flow paths provided by the valleys slope away from the longitudinal axis toward the collecting location.

Further, in a preferred form the collecting location comprises a surface region recessed relative to the ridges and extending continuously in a 360° curve around the inner surface of the side wall. The condensate collecting means comprises a tubular member having an inlet position adjacent to the recess region.

Also, in the preferred form, the collecting location is positioned between two sets of ridges and valleys, with each set of ridges and valleys having outer locations spaced farther from the collecting location toward the end walls, and inner locations positioned adjacent to and capable of directing flow of condensate into, the collecting location. Also in a preferred form, the ridges have a crest portion closer to the longitudinal axis, extending along a lengthwise dimension of its related ridge, and ridge side surfaces extending away from the crest portion away from said longitudinal axis divergently. Thus, condensate forming on the crest portions of the ridges flows away from the longitudinal axis along said side surfaces, in a condition where said roll structure is rotating so that the condensate is in a rimming condition distributed substantially entirely around the interior surface of the roll.

In the particular configuration shown herein, the crest of the ridges have a narrower width dimension adjacent to the collecting locations, and the width dimension increases in a direction from the inner end of the ridges toward the outer end of the ridges.

Also, in the preferred embodiment shown herein, the side wall comprises an outer cylindrical shell, and at least one generally cylindrical insert positioned in heat transfer contact with the shell. The ridges and valleys are formed at the inside surface of the insert.

In the particular embodiment shown herein, the roll structure is a corrugating roll having an outer surface of a plurality of longitudinally extending ridges separated by recesses. Also, the insert itself may be made in two separate portions, spaced from one another, so that the collecting location is between the two separate insert portions and is defined by the interior surface of the shell.

In the method of the present invention, a roll assembly is provided such as noted above. While the roll is stationary, the condensate collecting on the interior surface of the roll flows into the valleys to the collecting location, where the condensate is removed. In the rimming condition, the centrifugal force causes the condensate to flow into the valleys and to the collecting locations where the condensate is removed. In both instances, there is improved heat transfer through the roll, and also more uniform heating throughout.

Other features of the present invention will be come apparent from the following detailed description.

BRIEF DESCRIPTION OF THE DRAWINGS

FIG. 16 is a longitudinal sectional view of a steam feed/condensate removal fitting for the embodiment of FIG. 11;

FIG. 17 is a sectional view, drawn to an enlarged scale, of an outside surface portion of the side wall of the roll shown in FIG. 12A, showing a modified form of the collecting area of the insert;

FIG. 18 is a view similar to FIG. 11, showing a modified form of the insert made as two seaprate portions, with the condensate collecting area being positioned therebetween;

DESCRIPTION OF THE PREFERRED EMBODIMENTS a. Brief Review of Prior Art Steam Roll Designs It is believed that a clearer understanding of the present invention may be achieved by first examining the common prior art steam heated rolls and their associated apparatus.

Figure 1:
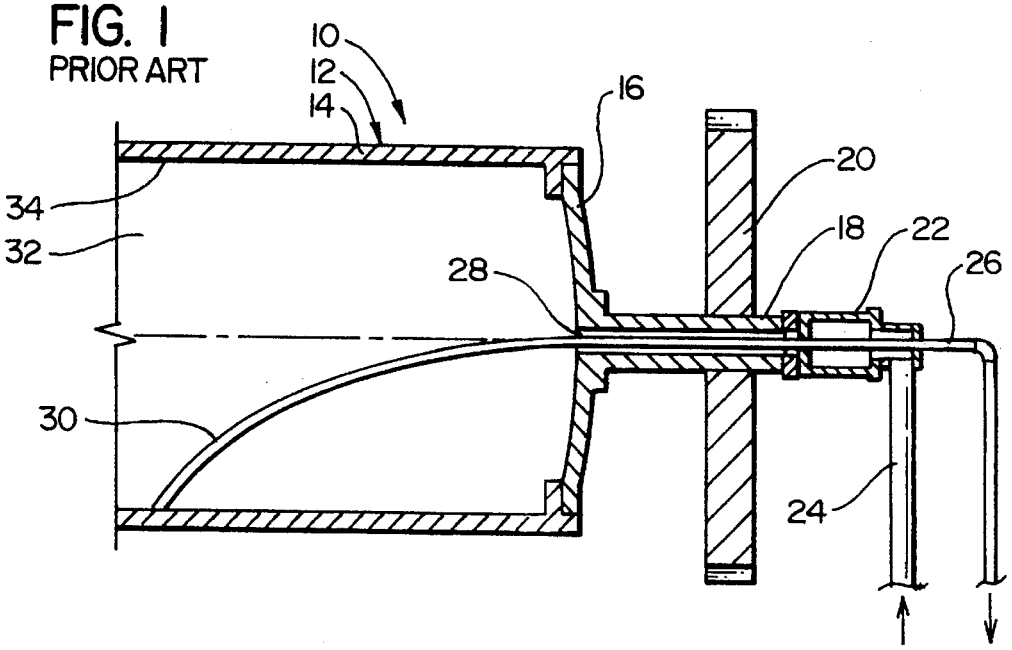
FIG. 1 PRIOR ART
FIG. 1 is a longitudinal sectional view of a portion of a prior art steam heated roll with one type of condensate removal (siphon) system.

One such steam heated roll assembly 10 is shown in FIGS. 1, where there is a roll 12 having a cylindrical side wall 14 and end walls 16. Bearing members or trunnions 18 are provided at each end wall 16. There is a drive gear 20 connected to one bearing member 18 to rotate the cylinder.

To provide for the steam to be fed into the roll and for removal of condensate, there is a steam joint 22 which attaches to a steam inlet pipe 24 and also to a condensate outlet pipe 26 positioned in one of the end bearing members 18. A steam inlet passageway is indicated at 28. Also, there is provided a siphon 30 that withdraws the condensate from the chamber 32 defined by the interior surface 34 of the side wall 14 and also the interior surfaces 36 of the two end walls 16.

In operation, the steam enters through the conduit 24 and into the chamber 32 to condense on the interior surface 34 of the side wall 12 and also to some extent on the surfaces 36 of the two end walls 16. When the roll is stationary, the condensate collects on the bottom of the roll 12, where the siphon 30 removes the condensate. When the roll 12 is rotating at a sufficiently high velocity, so as to cause a rimming condition, the siphon 30 draws out the condensate from the film of condensate passing beneath. Since there must be a certain amount of clearance between the inlet end 38 of the siphon and the side wall surface 34, the thickness of the condensate film in the rimming condition is generally between about one to three millimeters, depending upon the amount of clearance and the location within the roll 12.

Figure 2:
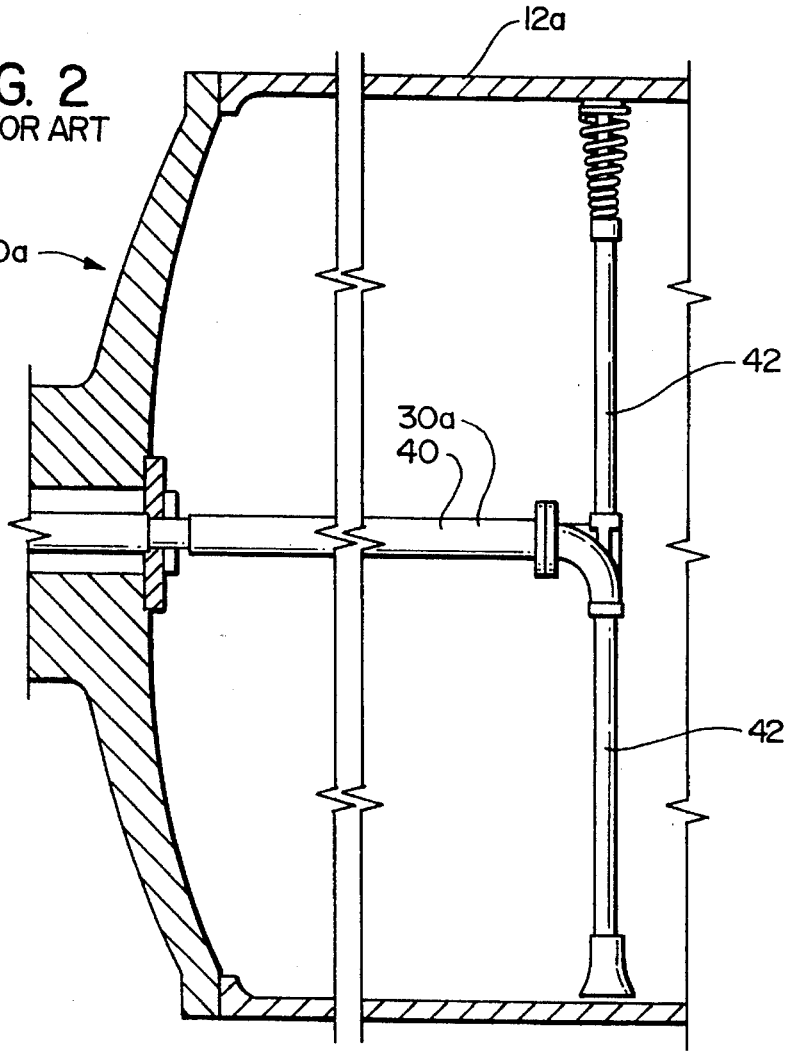
FIG. 2 PRIOR ART
FIG. 2 is a longitudinal sectional view of another prior art steam heated roll assembly having a different condensate removal device.

A second type of a prior art steam heated roll assembly is shown at 10*a* in FIG. 2. In this instance, the roll 12*a* has within it a siphon 30*a* where there is a longitudinally aligned siphon pipe 40*b* and oppositely extending and radially extending arms 42 that rotate with the roll 12*a*.

Figure 3:
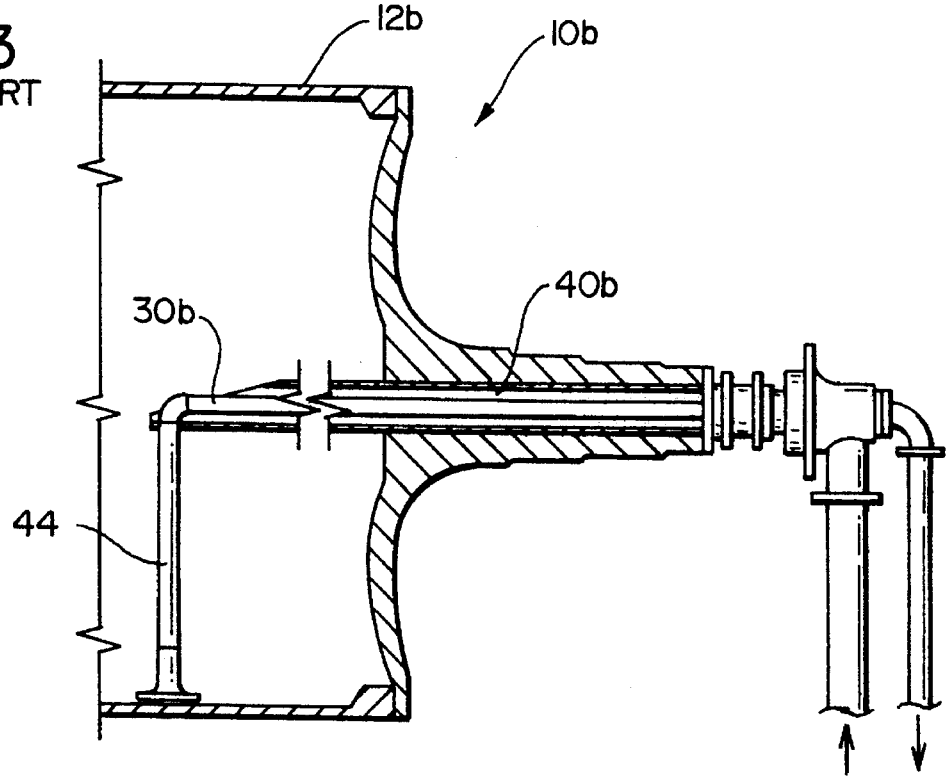
FIG. 3 PRIOR ART
FIG. 3 is a longitudinal sectional view showing yet a third prior art steam heated roll assembly.
Figure 4:
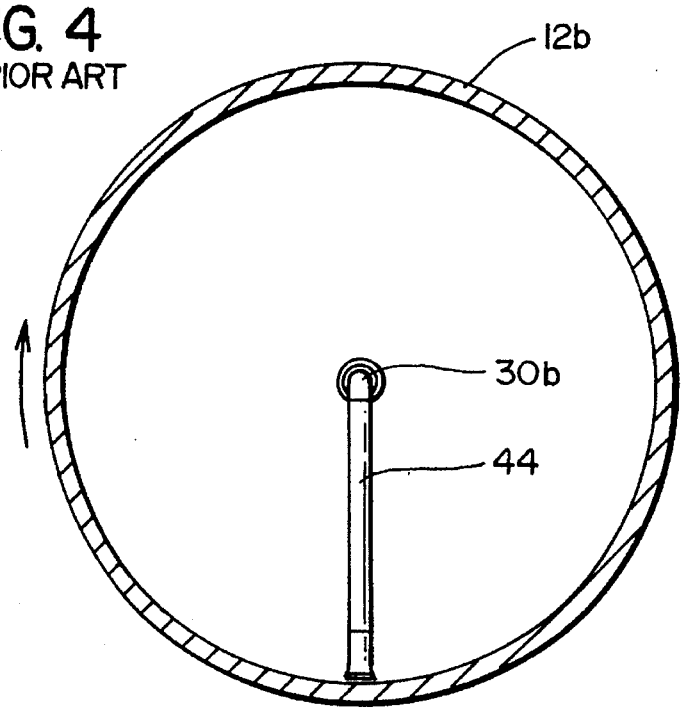
FIG. 4 PRIOR ART
FIG. 4 is a longitudinal sectional view of the apparatus shown in FIG. 3.

A third type of prior art roll assembly 10*b* is shown in FIG. 3 and 4, where there is a roll 12*a* having therein a siphon 30*b* having a horizontal arm portion 40*b* and a single radially extending siphon return arm 44.

Figure 5:
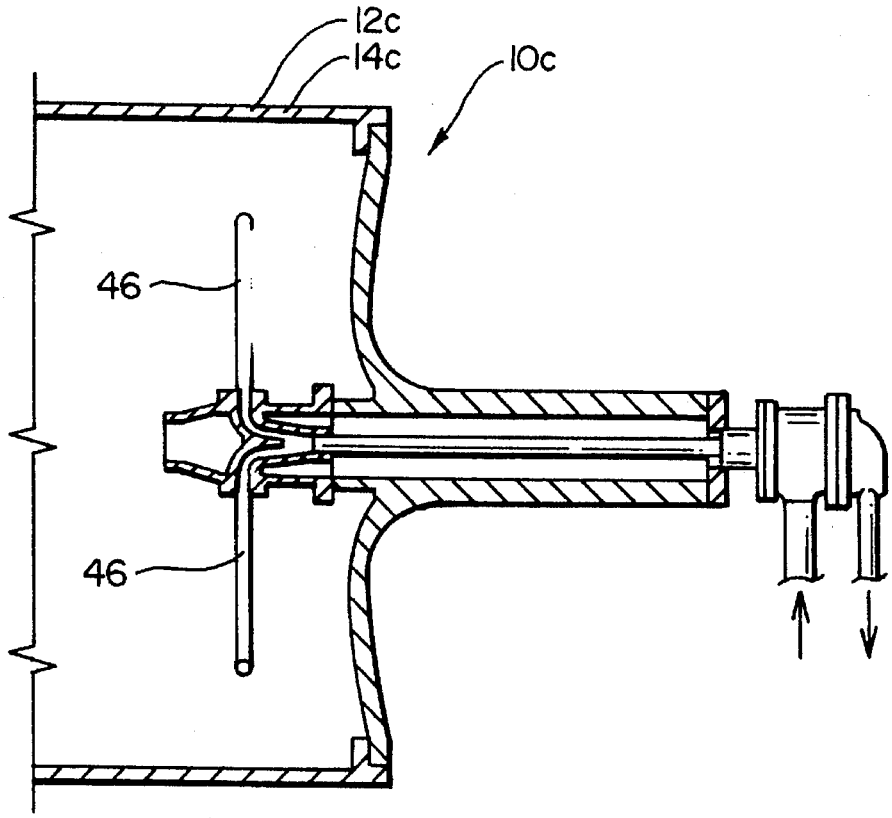
FIG. 5 PRIOR ART
FIG. 5 is a longitudinal sectional view of yet a fourth prior art steam heated roll.
Figure 6:
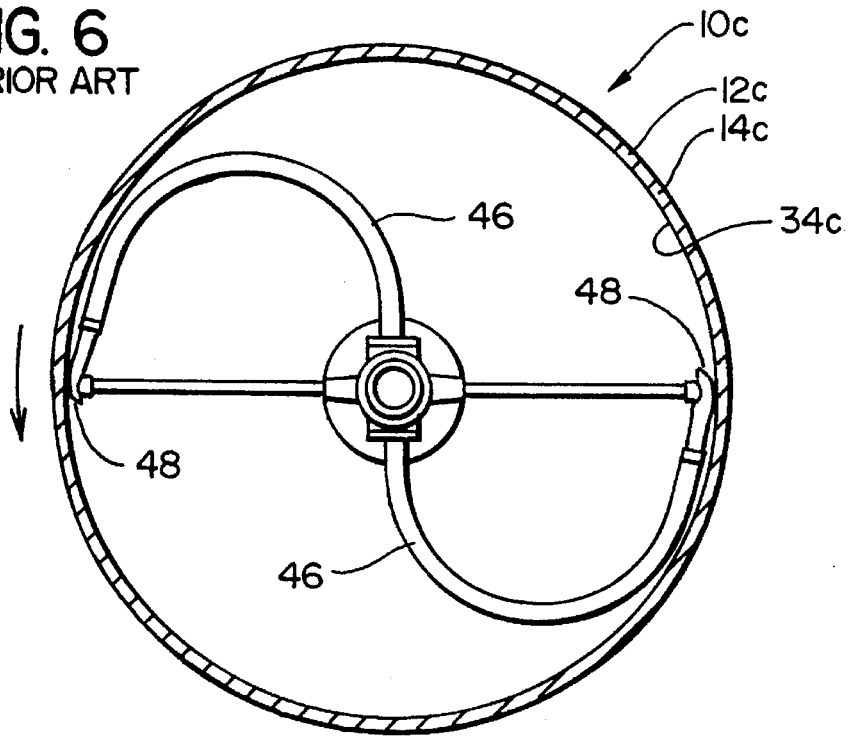
FIG. 6 PRIOR ART
FIG. 6 is a transverse sectional view of the apparatus of FIG. 5.

Yet a fourth prior art roll assembly 10*c* is shown in FIGS. 5 and 6. There are two generally semi-circularly curved siphon arms 46 which have condensate inlets at 48 that are nearly tangentially aligned with the interior surface 34*c* of the side wall 14*c* of the roll 12*c*. The inlets 48 are located so that these function to "scoop" the condensate into the inlet 48.

b. Heat Transfer Characteristics of Prior Art Roll Assemblies

Figure 7:
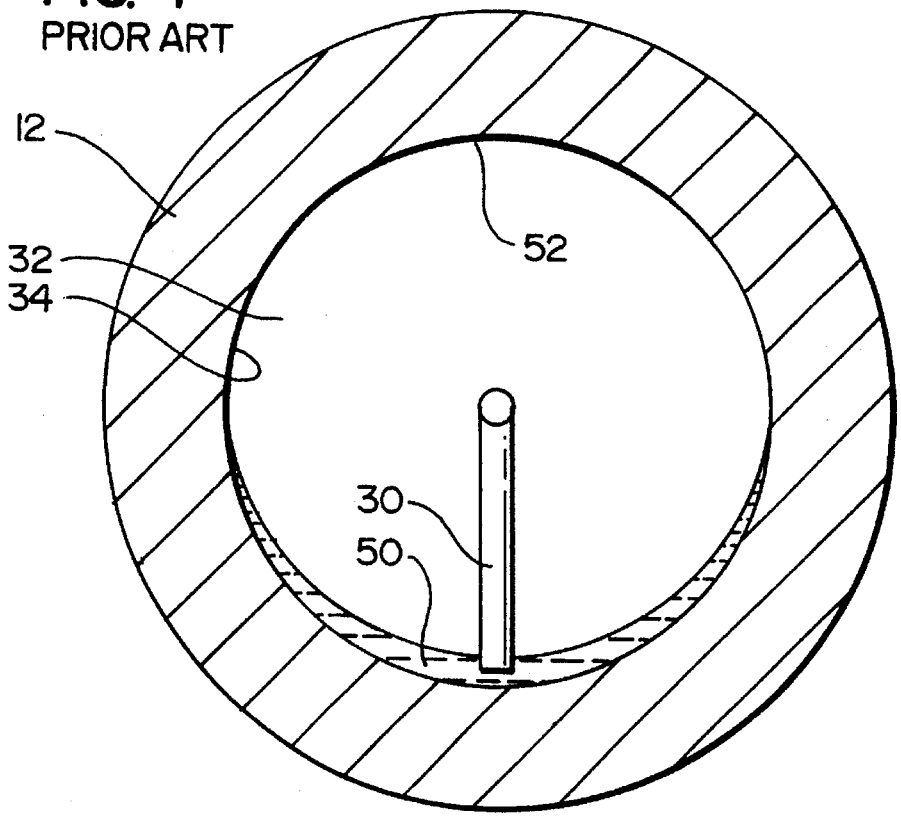
FIG. 7 PRIOR ART
FIG. 7 is a longitudinal sectional view of a prior art steam heated roll, which is stationary, thus forming a "puddling" condition.
Figure 8:
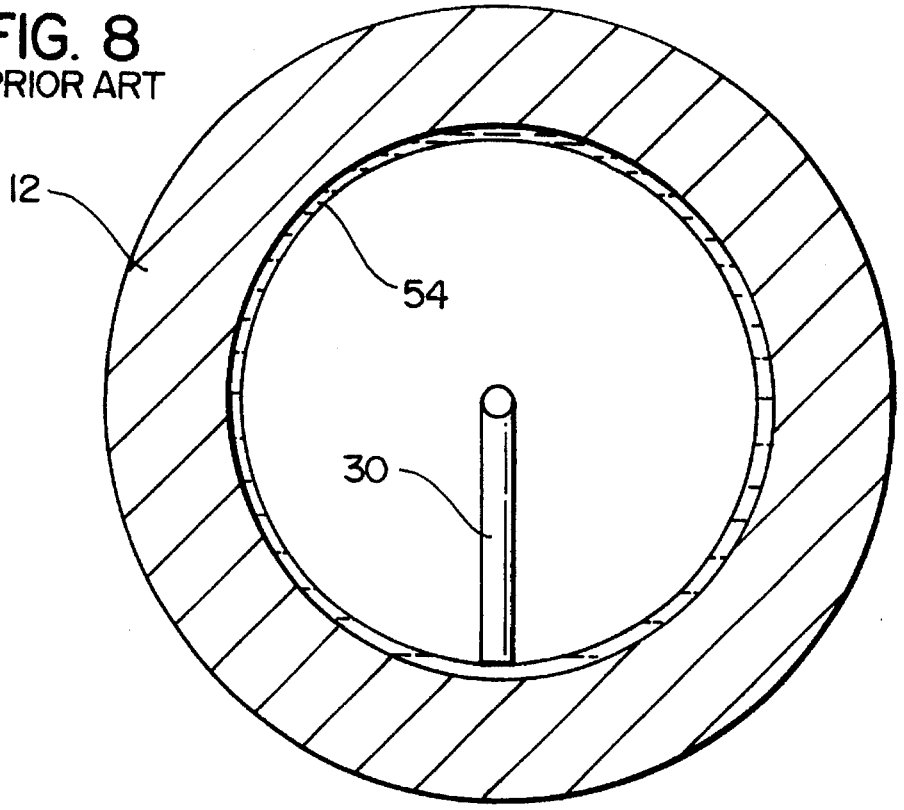
FIG. 8 PRIOR ART
FIG. 8 is a sectional view similar to FIG. 7, but showing the condensate film formed during the rimming condition.

Reference is now made to FIGS. 7 and 8 which show a prior art steam heated roll 12 in cross-section, having a single siphon 30. In FIG. 7, the roll 12 is stationary, and it can be seen that condensate has collected at 50 in the bottom part of the roll interior chamber 32. There is a small amount of moisture which collects in droplets along the top and side surface portions 52 of the interior surface 34, and these droplets in turn run down to the lower puddle at 50. Since any film that forms in the upper and side interior surface portions 52 is relatively small, heat transfer at those locations is relatively high. With water being a poor conductor of heat, the heat transfer at the lower puddle location 50 is relatively poor.

In FIG. 8, the roll 12 is shown in the rimming condition. It can be seen that a substantially uniform film has formed at 54. The centrifugal force, with the roll 12 rotating at full speed, is higher than the force of gravity, so that the condensate film 54 is relatively uniform. As indicated above, generally this film 54 can be between about one to three millimeters, depending upon the clearance of the siphon with the interior wall 34, and the precise location on the wall 12, relative to the location of the siphon 30.

Figure 9:
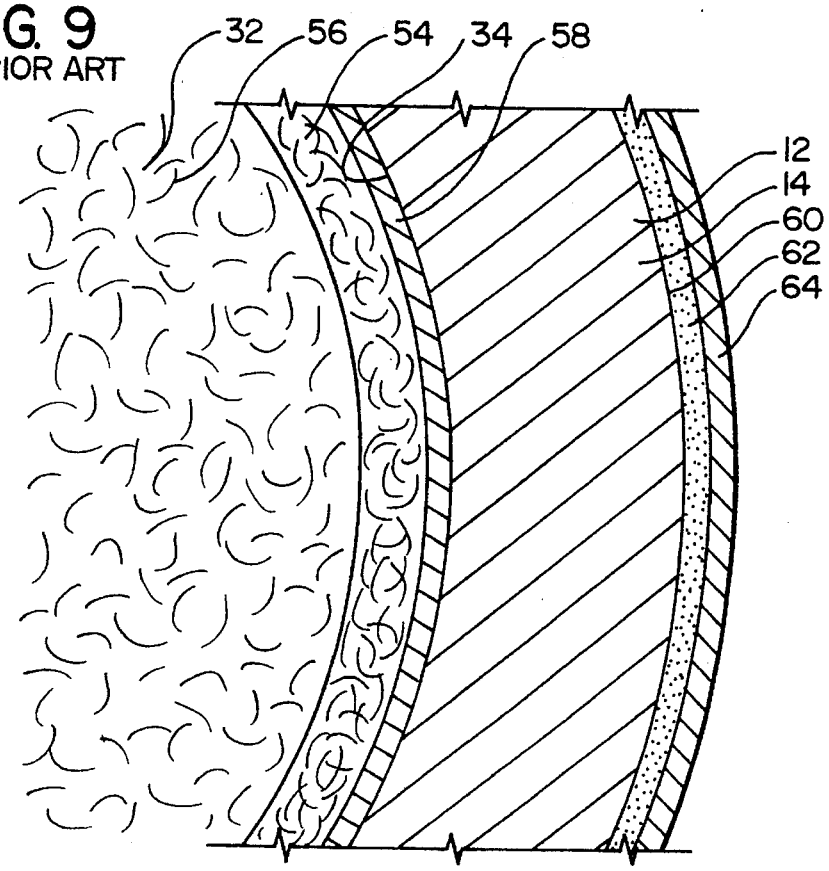
FIG. 9 PRIOR ART
FIG. 9 is a longitudinal sectional view of a portion of a prior art steam heated roll, showing the thickness dimensions (i.e. radial dimensions) of the various components substantially enlarged for purposes of illustration.

Reference is now made to FIG. 9, which shows a portion of the side wall 12 of a prior art roll in cross-section. For purposes of illustration and explanation, the thickness dimensions of the side wall and the various layers or films associated therewith are greatly exaggerated. There is the steam 56 in the roll chamber 32, and the condensate film 54 is shown in the rimming condition. Next to the condensate wall 54 is a layer 58 of scale and possibly contaminates which form against the interior surface 34 of the side wall 14. Immediately adjacent to the outside surface 60 of the side wall 14, there is a layer 62 of dirt and air, and outside of this there is shown a flat sheet of paper 64 which in this instance is being heated and dried.

This is a showing of temperature differentials across the various layers, and is not meant to be precise representations. The effect of the layer of condensate relative to heat transfer will be discussed in more detail below.

Figure 10:
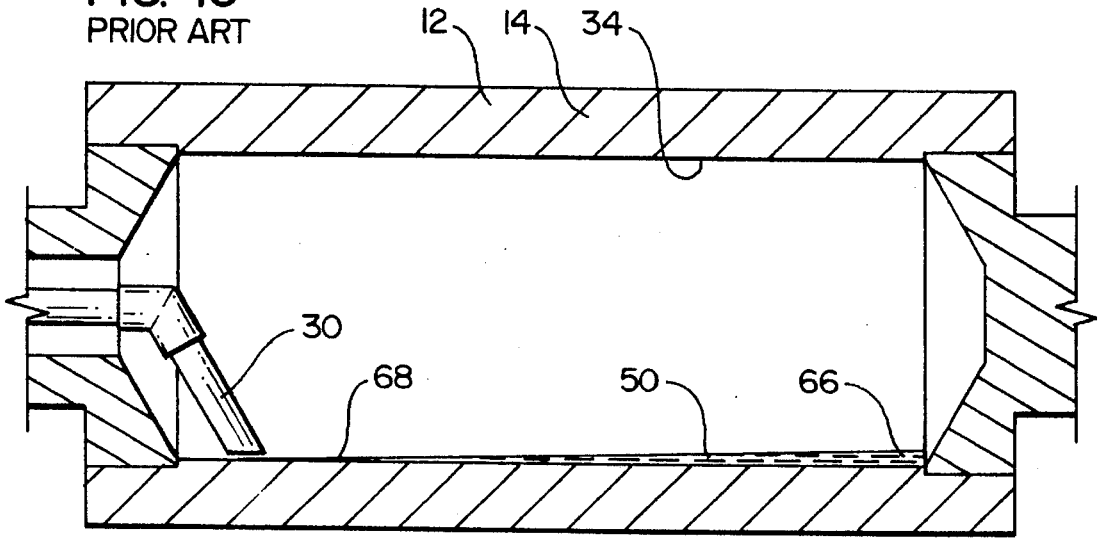
FIG. 10 PRIOR ART
FIG. 10 is a longitudinal sectional view of a prior art steam heated roll that is stationary, showing the depth distribution of the puddle formed at the bottom of the roll.

Reference is now made to FIG. 10 which shows the prior art roll 12 of FIGS. 7 and 8 in longitudinal cross-section, with a siphon tube 30 being located at one end of the roll. In this instance, the roll 12 is stationary so that the condensate collects as a puddle 50 in the lower part of the roll side wall 34. It will be noted that the puddle 52 is higher at the far end 66, relative to the siphon 30 and shallower at a location 68 closer to the siphon 30. The reason for this is that there is only the force of gravity acting on the puddle 50 to cause it to flow to the siphon 30 as the water is being drawn out.

Since water is a relatively poor conductor of heat, the temperature of the outer surface portion of the side wall 14 at the location of the deeper portion 66 of the puddle 50 would be somewhat lower than the temperature of the side wall portion adjacent to the thinner portion 68 of the puddle 50. Further, the temperature of the outer surface of the side wall at an upper and side locations would be somewhat greater than that which exists at the outer surface adjacent to the puddle locations 68 and 66. As indicated previously in this text, this accumulation of condensate as a somewhat non-uniform puddle at the lower part of the roll 12 during period when the roll 12 is not rotating results in a non-uniform temperature at the outside surface of the roll side wall 14. Thus, as indicated previously, for a certain period after the roll 12 starts to rotate, this non-uniform temperature condition remains and is detrimental to the proper operation of the roll.

c. Description of the Preferred Embodiments of the Present Invention

Figure 11:
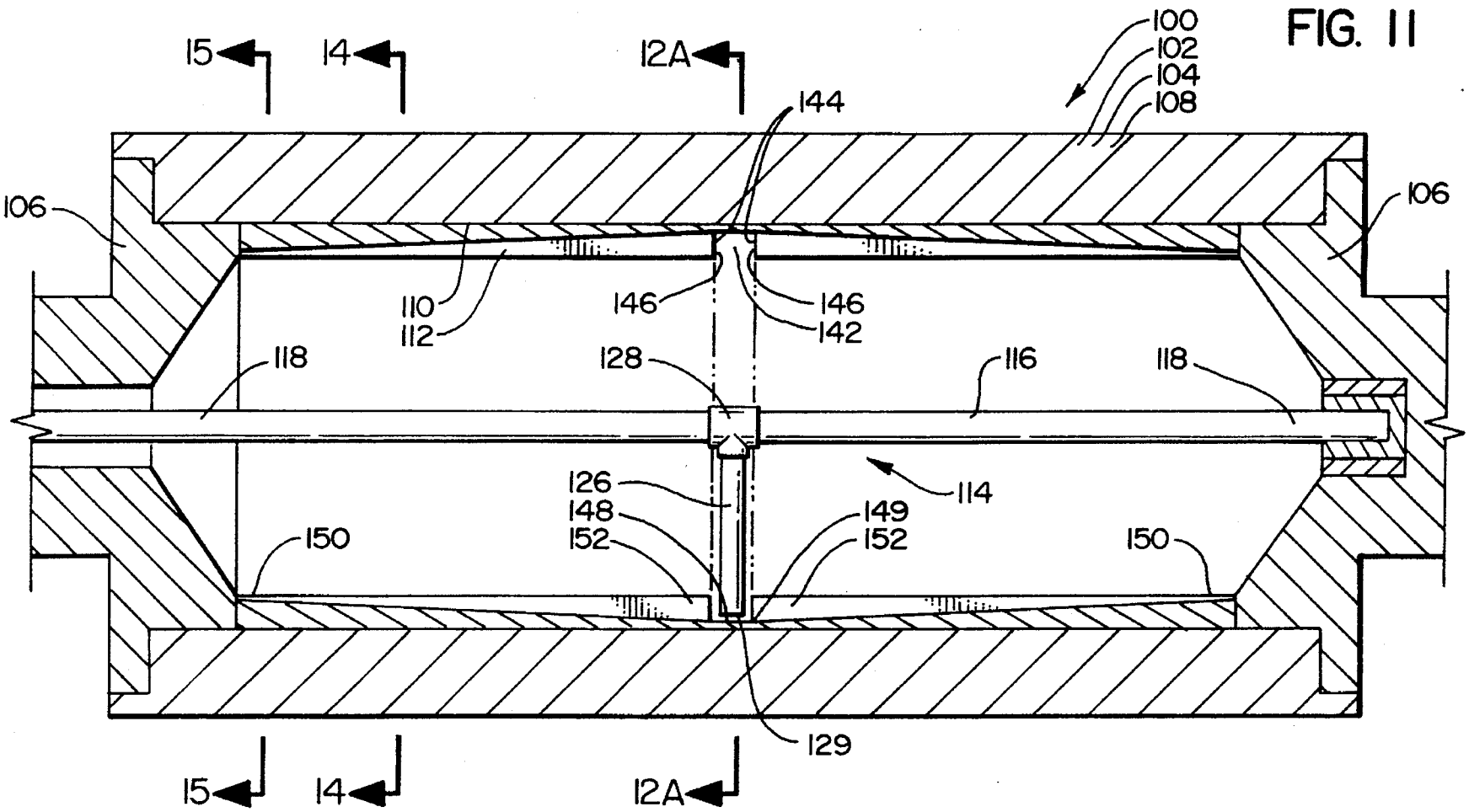
FIG. 11 is a longitudinal sectional view of a preferred embodiment of the present invention.

To describe the preferred embodiment of the present invention, reference is first made to FIGS. 11 through 17. As shown in FIG. 11, there is the roll assembly 100 of the present invention comprising a roll 102, having a cylindrical side wall 104 and two end walls 106. The side wall 104 comprises an outer cylindrical shell 108 having an inner cylindrical surface 110, and an insert 112 positioned snugly within the outer cylindrical shell 108. The configuration and function of this insert is particularly significant in the present invention, and this will be described in greater detail later herein.

There is a siphon assembly 114, comprising a centrally located, longitudinally extending pipe 116 supported at opposite ends 118 within the end walls 106. At one end wall 116, there is provided a steam inlet and condensate outlet fitting 120 which is, or may be, of prior art configuration. Such a fitting is illustrated in FIG. 17 and it can be seen to comprise a inner condensate removal pipe 122 surrounded by an annular steam inlet passage 124. This particular fitting shown in FIG. 16 already exists in the prior art, and is currently marketed by the Johnson Corporation. Accordingly, this fitting 120 will not be described in detail herein.

Connected to the center of the middle feed and support tube 116 is a siphon tube 126 which extends radially downwardly from a center coupling 128 for the pipe 116 and has at its lower end an inlet 129. While only one siphon tube 126 is shown herein, there could, of course, be additional siphon tubes and various arrangements of the same would be possible, as shown in the prior art in FIGS. 1 through 6, or variations of the same.

To turn our attention back to the roll insert 112, as indicated previously, the structure and functional features of this insert 112 are particularly significant in the present invention. In general, this insert 112 substantially improves the heat transfer characteristics of the roll 102 both with regard to improved rate of heat transfer (both in the rimming condition and the stationary "puddle" forming condition), and with regard to greater uniformity of temperature at the outer surface of the roll side wall 104.

The roll insert 112 is formed in a general configuration of a cylinder having open ends. As shown in FIGS. 12 and 13 The outer surface 133 of the insert 112 is cylindrically shaped and fits against the inside surface 110 of the outer side wall shell or cylinder 108 in close metal to metal contact so as to ensure optimized heat transfer between the two. The insert 112 is formed with two opposed sets of longitudinally extending grooves or valleys 130 which are distributed evenly around the entire inside surface of the insert 112. These grooves 130 are arranged parallel and adjacent to one another so as to form a plurality of longitudinally extending ridge members 131 separated by adjacent valleys 130.

In describing the arrangement of these ridges 131 and valleys 130, the term "upper" shall denote proximity to the longitudinal center axis 134 of the roll side wall 104, and the term "lower" shall denote a distance further away from the longitudinal center axis 134. The term "inner" shall refer to proximity to the longitudinal center location of the roll 102 (or shall denote a direction toward that location), while the term "outer" shall denote proximity to one or the other of the end walls 106 or a direction toward either of the two end walls 106.

Each ridge member 131 has an upper crest 136 formed by two adjacent walls 138 of that ridge member 131. Each valley 130 has a lower valley floor or apex line 140 which is formed by adjacent side walls 138 of adjacent ridge members 130. In FIGS. 12 and 13, the ridges 131 and valleys 130 are shown in transverse section across a longitudinal axis 134 at the center location of the roll 102.

The two sets of ridge members 131 and valleys 130 are separated at the longitudinal center of the roll 102 by a continuous circumferential collecting groove or recess 142, the two side walls 144 of which are formed by the terminal faces 146 of the central end portion of the ridge members 131. The floor 148 of the central circumferential groove 142 is a flat cylindrical surface following a continuous uniform 360° curve around the insert 112. In FIG. 11, the floor 148 of the recess 142 is shown as being at the same level as the lowermost location 149 of the apex line 140 of the valley where it meets the floor 148. In FIG. 17 there is shown a modified version where the floor, (indicated at **148*a*) of the recess 142*a* is made slightly lower than the apex line location 149*a* to facilitate draining the condensate from the valleys 130*a***.

Figure 15:
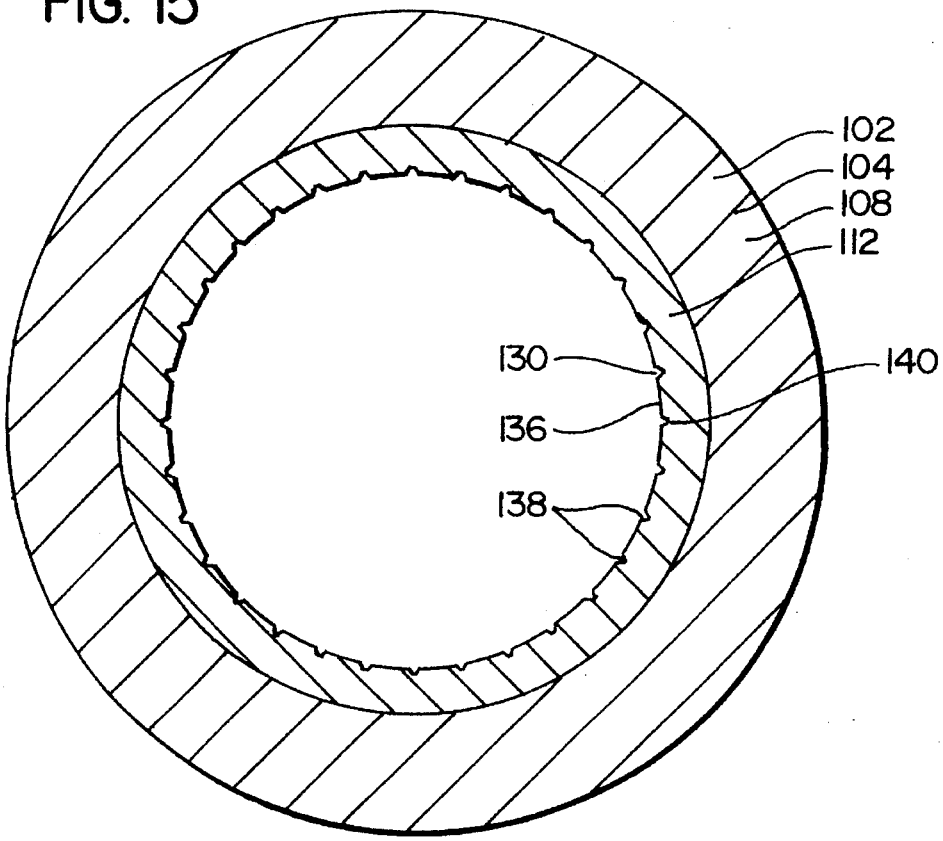
FIG. 15 is a sectional view taken along line 15—15 of FIGS. 11.

Also, each groove or valley 130 slopes slightly downwardly from outer end locations 150 to a center end location 152 adjacent to the center groove 142. More particularly, as can be seen in the cross-sectional view of FIG. 14, as the valley or groove 130 extends outwardly toward its related end wall 106, its lower apex line 140 slants upwardly, but the side walls 138 maintain their same angular orientation. Thus, the crest 136 of each ridge member 130 becomes wider, while the distance between the edges of each crest 136 becomes smaller. In a further end location as shown in FIG. 15, it can be seen that at the outer end of each groove 130, the depth of each valley 130 has diminished to only about one fifth to one tenth of the depth of the valley 132 at the center location.

d. Operation of the Preferred Embodiment of the Present Invention

Figure 12A:
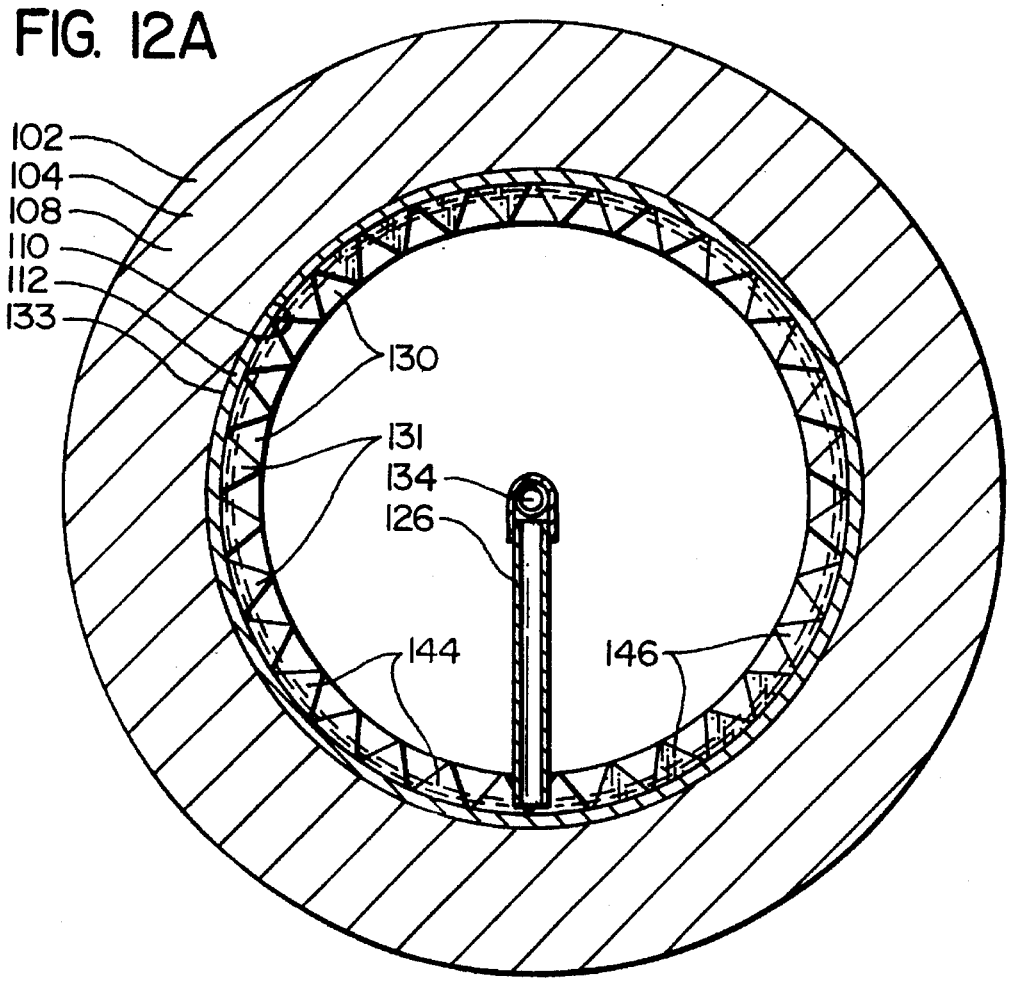
FIG. 12A is a sectional view taken along line 12—12 of FIG. 11, showing the roll in a rimming condition.
Figure 13A:
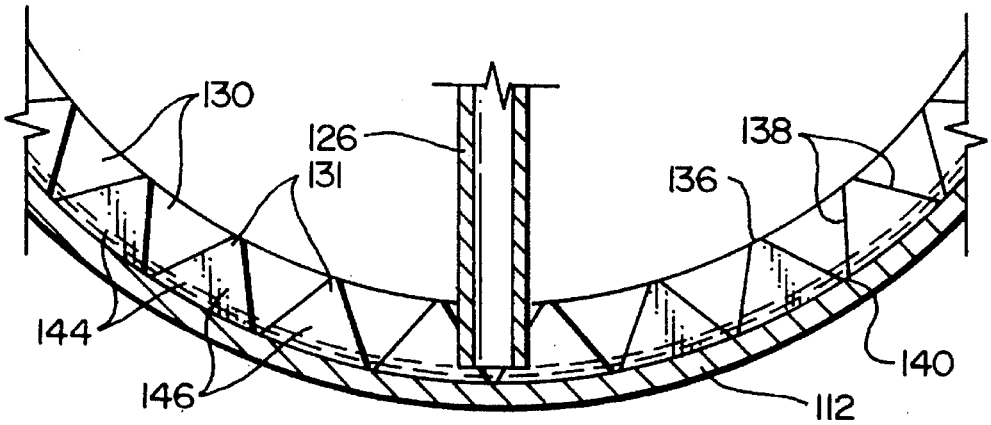
FIG. 13A is a transverse sectional view taken at the same location as FIG. 12A, but showing only a portion of the side wall insert, drawn to enlarged scale.
Figure 12B:
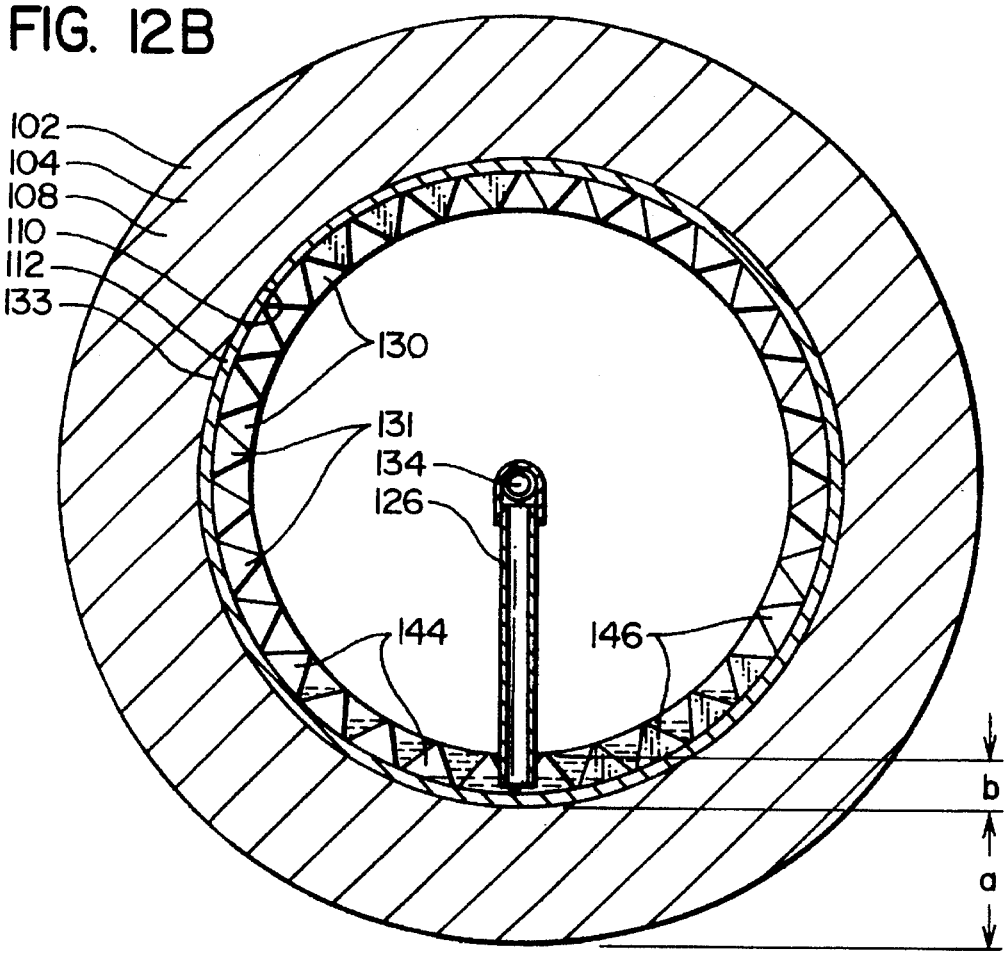
FIGS. 12B and 13B are views similar to FIGS. 12A and 13A, respectively, but showing the roll stationary in the "puddling" condition.

With reference to FIGS. 12A and 12B, let it first be assumed that the roll 102 is rotating at full speed so as to be in the rimming condition. It can be seen that the condensate will collect in the lower portion of each valley or groove 130. Since the valley floor or apex line at the bottom of each groove or valley 130 slopes "downwardly" (which means it slopes in a direction away from the longitudinal center axis 134 about which the roll rotates), the centrifugal force is in a radially outward direction. This causes the condensate to flow down the grooves or valleys 130 to the center collecting groove or recess 142, where the siphon tube 126 carries the condensate outwardly through the pipe 116.

The steam in the chamber 132 condenses on substantially all of the surface areas of the interior of the roll 102. As the condensate collects on the side walls 138 of each ridge 131, it flows downwardly into the area at the valley floor or apex line 140. Condensate which forms on the flattened portion of the crests 136 of each ridge 131 has a very short distance to flow laterally into the adjacent grooves 130. Thus, there is at most a very thin film of condensate that forms on those flattened areas of the crests 136, since the centrifugal force exerted on the film tends to cause the flow into the grooves or valleys 130.

Thus, it becomes evident that any film forming on any of the interior surface portion of the insert 112 tends to flow into the grooves, and then longitudinally along the grooves toward the center circumferential groove 142 to be extracted by the siphon 126. The overall result is that this diminishes the film thickness in most all parts of the interior of the roll insert 112 to a rather small fraction of the film thickness that would exist in a conventional prior art roll during the rimming condition.

To explore another facet of the heat transfer characteristics of the present invention, it is evident that with the formation of the valleys 130, there is increased total surface area of the interior surface of the insert 112. Since the rate of heat transfer has a functional relationship to the area on which the steam is condensing, this arrangement further enhances the rate of heat transfer.

Figure 13B:
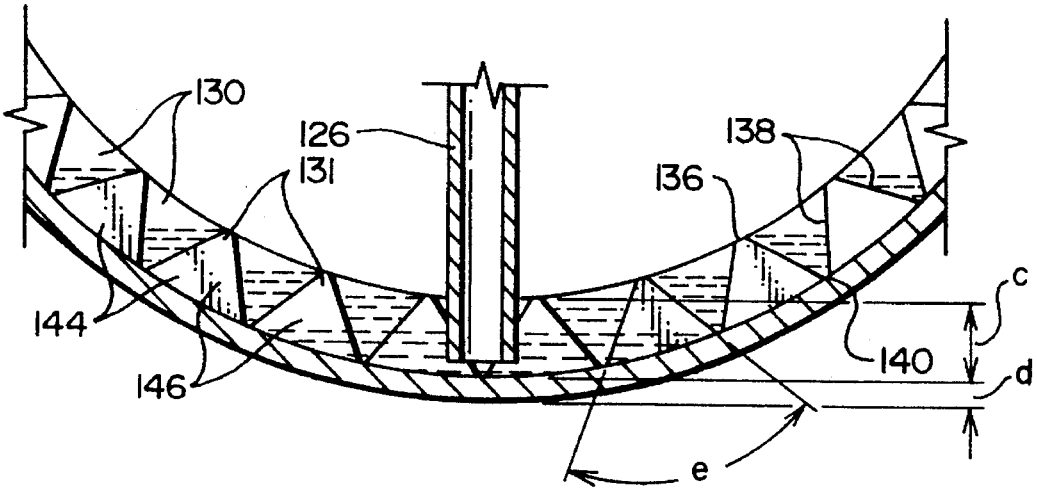
Figure 14:
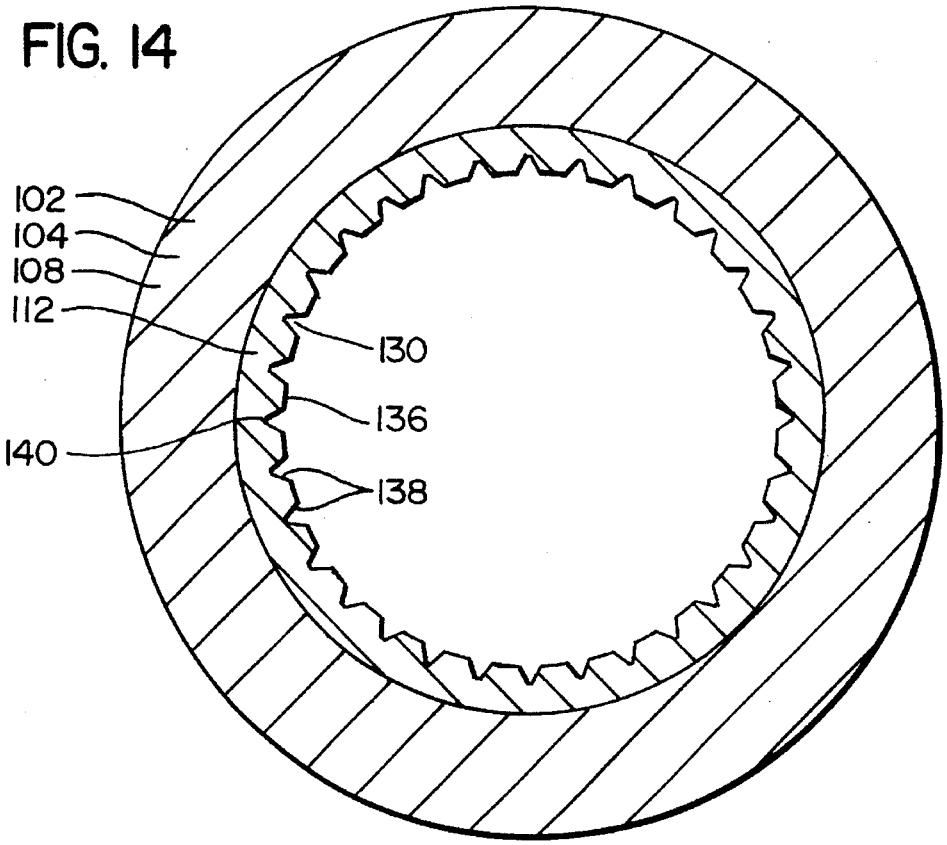
FIG. 14 is a sectional view taken at line 4—14 of FIG. 11.

Let us now examine the condition of the roll 102 when it is stationary so that a puddle forms in the bottom of the roll 102. Reference is made to FIGS. 12B and 13B. Since the valley floor or apex line 140 slopes from the end walls 106 toward the center collecting groove 142, there is gravity flow of the condensate collecting in the grooves 130 (which are positioned at a lower location) toward the center location, where the siphon 126 collects the condensate to discharge it to a location outside the roll 102. It is evident from viewing FIGS. 12B and 13B that the upper portion of the side walls 138 of the ridges 131 at a lower position have condensate only in the lower portion of each groove or valley 130, and substantial portions of the side surfaces 138 are exposed directly to the steam for optimum heat transfer. Also, at the flattened areas of the crests of the ridges 131 (see FIGS. 14 and 15), there is a very short distance for the condensate to travel to descend into the adjacent grooves 130. Thus, any film that forms in these locations would be relatively small.

To review further the heat transfer characteristics of the present invention, let us first consider approximate practical dimensions for a roll such as shown in FIGS. 12A–B and FIG. 13A–B.

A typical corrugating roll 102 could be, for example, two and half meters long, and have an inside diameter of possibly two hundred fifty millimeters. The thickness (indicated at "a") of the outer steel shell 104 could be, for example, fifty millimeters. The total thickness (indicated at "b") of the insert 112 could be, for example, about twenty millimeters. The total depth of each groove or valley 120 (indicated at "c") in FIG. 13B is approximately 15 millimeters. The thickness dimension from the valley floor or apex line 140 to the outside surface of the insert 112 (indicated at "d") in FIG. 13*b* is approximately five millimeters.

While the depth of each groove 130 is fifteen millimeters at the maximum, the depth of each groove 130 at its outer end (adjacent to the end wall 106) is only about three millimeters. Obviously, these dimensions, and also the configuration of the grooves could be varied. For example, the valley floor or apex line 140 could be made somewhat wider or somewhat rounded, and the same is true of the ridge crests 136. For ease in manufacture, the slope of the ridge side walls 138 is made uniform (so as to make an included angle) indicated at "e" in FIG. 13B of approximately sixty degrees. This slope could be varied, and possibly be made different at certain locations. Or there could be a compound slope, such as forming the slope of the side walls 138 near the end walls at a shallower angle.

Desirably, for economic and structural reasons, the outer shell 108 is made of steel. The insert 112 is desirably made of aluminium, both for ease of manufacture costs and also thermal conductivity.

Thermal conductivity can be measured according to the following relationship, namely:

BTU'S/(hr) (sq. ft) (°F.)/per ft of thickness According to this measure of thermal conductivity, the thermal conductivity of certain materials are given below.

| | |
|---|---|
| Aluminum | 121 |
| Steel | 25.6 |
| Copper | 222 |
| Dural (an alloy) | 119 |
| Water | 0.38 |

To put these relationships in perspective, let it be assumed that it is desired to transfer one thousand BTU's per square feet per hour through a film of water which is one millimeter thick. To accomplish this, there would have to be a temperature deferential of 8.6° F. imposed. To accomplish this same rate of heat transfer for steel which is fifty millimeters thick, it would take only 6.5° F. temperature differential. To accomplish this rate of heat transfer for aluminum that is five millimeters thick, the temperature differential required would be 0.14° F.

An analysis of these relationships, relative to the distribution of the condensate and the condensate film in the rimming condition and the stationary "puddling" condition of the roll 102, clearly indicates that not only is the rate of heat transfer enhanced, but also the uniformity of the heat transfer (particularly to solve the problems of temperature differential at the outside surface at the "puddle" location).

First, in the rimming condition, in the prior art roll 12 there is generally a film thickness between about one millimeter to three millimeters. On the other hand, in the present invention, during rimming, the great majority of the inside surface of the insert 112 has substantially little if any of the condensate film thereon, since the condensate collects in the apex lines 140 of the grooves 130. It is apparent that even with the significant effect of a one millimeter layer of condensate, this provides significant improvement in heat transfer.

In the puddling condition where the roll 102 is stationary, the condensate that collects in the grooves or valleys 130 is constantly flowing 10 toward the center location. Further, the side walls 138 have a relatively steep slope, and thus have very little film condensate thereon. At the very central portion of the roll where the grooves or valleys 130 have a maximum depth, even though there will be a certain amount of collection in the lower part of these grooves 130, substantial portions of the side walls 138 will have very little (if any) condensate remaining thereon. Thus, even at the puddle location itself, there are significant areas having little if any film, thus providing a relatively large area for the flow of thermal energy without being obstructed by a layer of film condensate.

A further modified form of the present invntion is shown in FIG. 18, where the insert 112 is made as two separte sections 112*b* and 112*c*. This is accomplished by deleting the material of the insert 112 that is at the location of the recess so that the inside surfaces 146*b* of the inner side walls of the insert sections 112*b* and 112*c* are spaced from one another and the exposed middle inside surrace portion 152 of the inner surface of the shell 108*b* forms the surface at which the condensate collects.

Figure 19:
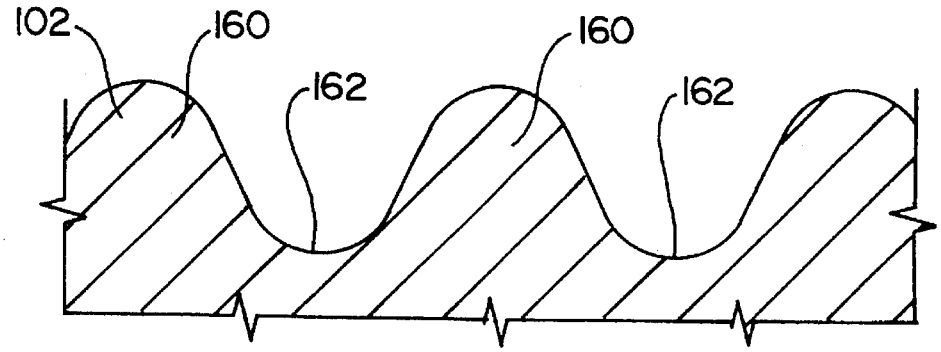
FIG. 19 illustrates in transverse section the corregated surface of the roll used in one preferred form of the present invention.

The preferred embodiment was specifically designed for a corrugating roll, but within the broader scope of the present invention, the basic concepts of the present invention could be applied to other types of rolls such as drying rolls for pulp or paper, etc. To illustrate the configuration of a corrugating roll of the specifically disclosed embodiment, reference is made to FIG. 19 which is drawn to enlarged scale and shows a portion of the roll 102 circled at FIG. 112. It can be seen that there is on the exterior surface a series of ridges 160 separated by recessed portions or grooves 162. As indicated previously, a matching set of rolls is positioned one against the other with the ridges and grooves of the rolls that are interfitting with one another to give the paper or cardboard its corrugated configuration.

Figure 20:
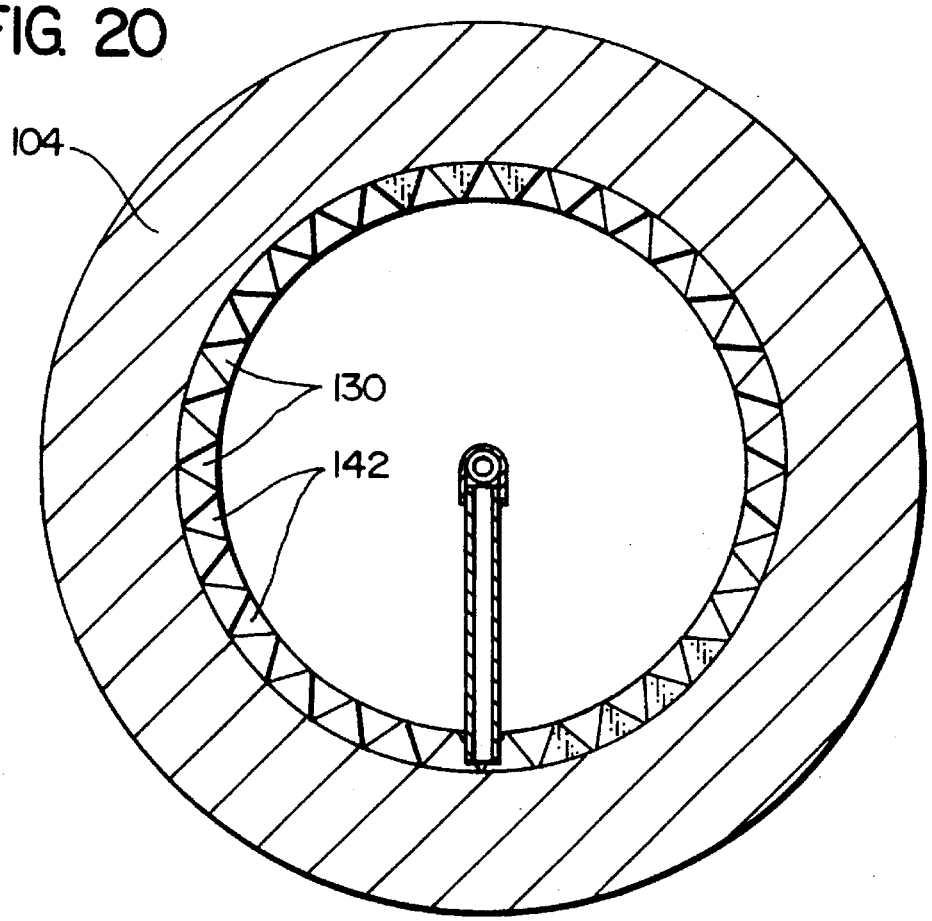
FIG. 20 is a view similar to FIG. 12A, but showing the roll side wall 104 made as a single casting.

Also, it is to be understood that the side wall 104, instead of being made in two parts (i.e. as a shell 108 and an insert 112), this could be made as a single casting, where the grooves 130 and the collecting groove 142 can simply be machined into the interior surface. This is illustrated in FIG. 20.

Figure 21:
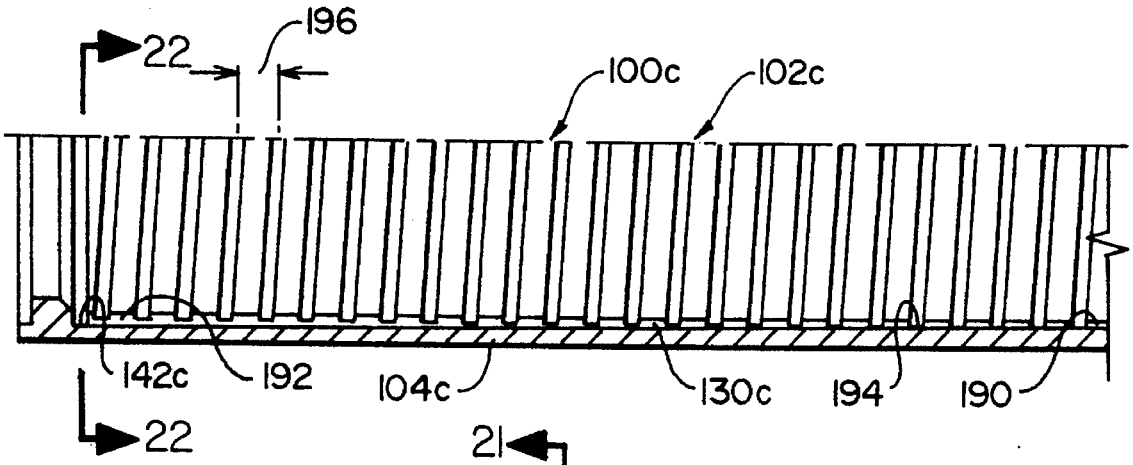
FIG. 21 is a sectional view of a fourth embodiment of the present invention, this view being taken along line 21—21 of FIG. 22; this being a longitudinal sectional view which, for ease of illustration, illustrates only that portion of the roll on one side of the longitudinal center line, and also illustrating only one half of the roll, measured from a longitudinal center location to one end of the roll.
Figure 22:
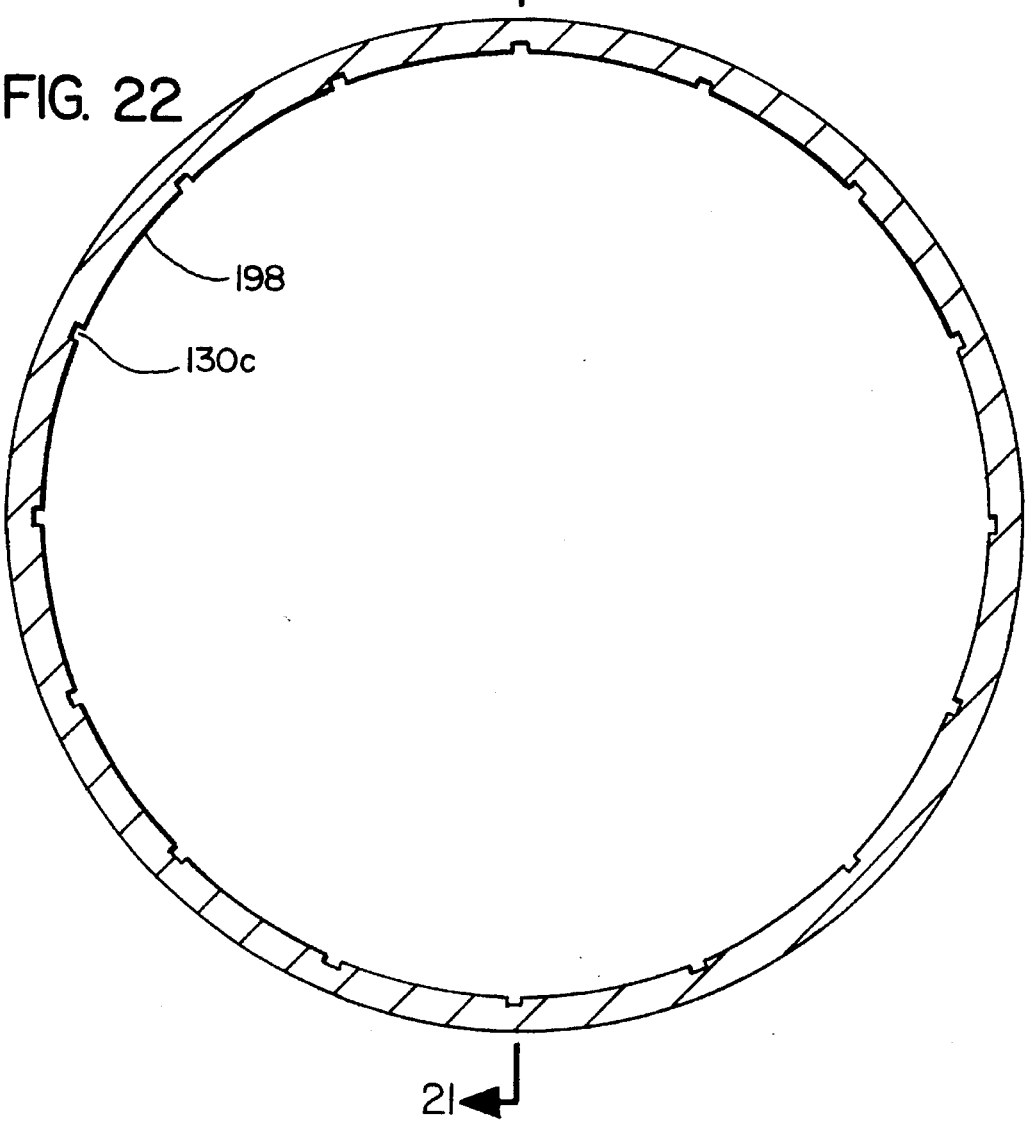
FIG. 22 is a transverse sectional view, drawn to an enlarged scale, relative to FIG. 21, taken along line 22—22 of FIG. 21.

A further embodiment of the present invention is illustrated in FIGS. 21 and 22. Components of this fourth embodiment which are similar to prior embodiment will be given like numerical designations, with a "c" suffix distinguishing those of the fourth embodiment.

This fourth embodiment is particularly adapted for use in a roll that is used in fast paper drying machines. These rolls can be, for example, 1.8 meters in diameter, and 10 meters long. Normally, in a paper drying operation, the roll rotates substantially continuously so that the condensate within the roll is substantially always in the rimming condition.

With reference to FIGS. 21 and 22, for convenience of illustration, there is shown only the cylindrical sidewall 104*c* of the roll 102*c* of the entire assembly 100*c*. It is to be understood, however, the roll 102*c* also has end walls, and there is a siphon assembly (these are not shown for ease of illustration).

In this fourth embodiment, there is a plurality of longitudinally extending grooves 130*c* along the interior surface. However, in this fourth embodiment, there are relatively few grooves 130*c* and these are spaced further apart from one another. In the particular embodiment shown herein, there are sixteen grooves 130*c* spaced about 22 ½° from one another. Also, in this particular configuration, the grooves 130*c* are shallower at a center location, indicated at 190, and deeper at an end location 192 adjacent to an end wall of the roll 104*c* (the end wall not being shown for ease of illustration), so that the flow of condensate is toward the two ends of the roll 102*c*.

At each end of the roll 104*c*, there is a circumferential recess or groove 142*c* in the inner surface which receives the flow of condensate from the grooves 130*c*. It is to be understood that there is a siphon tube which would extend down to the surface of each circumferential recess 142*c* to remove the condensate.

In this fourth embodiment the interior surface 110 of the roll side wall 104 is formed with a continuous spiral groove 194 which extends along substantially the entire length of the roll 104*c*. The pitch of the spiral groove 194 (this being indicated at 196), could be, for example, 100 millimeters. The depth of the spiral groove could be, for example, about 2 millimeters. Obviously, these dimensions could be changed, depending upon various design considerations. With the depth of the spiral groove being about two millimeters, the depth of the longitudinal grooves 130*c* would be at the shallower end 190 about 2 millimeters, and be deepest at the outside end 192 (e.g. about 5 to 10 millimeters). This depends to a large extent on the length of the cylinder 102*c* and other design factors.

In operation, the roll will be considered in the rimming condition. The condensate will form on the interior surface portions 198, and centrifugal force will cause this condensate to flow outwardly into the circumferential groove 194, with some of the condensate also flowing directly into the adjacent longitudinal groove 130*c*. The condensate that flows into the spiral groove 194 will then be caused to flow toward the adjacent groove 130*c* (which then becomes a collecting groove), with the flow in the groove 130*c* flowing longitudinally toward the recess 142*c*. The condensate collecting in each recess 142*c* is then removed by a related siphon.

It is believed that the benefits obtained in this fourth embodiment are evident from the prior description relating to heat transfer in the interior of the roll. The condensate which forms on the surface portions or segments 198 remains quite thin, to facilitate heat transfer at the inner surface of the roll.

One of the benefits of this fourth embodiments is in facilitating the economics and ease of manufacture of this roll 104*c*. Commonly the longitudinal grooves 130*c* would be made by a milling machine which would extend into the interior of the roll sidewall 104. On the other hand, the spiral groove 140 could be made by means of a lathe with the entire roll 104*c* rotating about its center axis. For economy of manufacture, it would usually be better to manufacture the groove 194 as a continuous spiral groove. However, within the broader scope of the present invention, this circumferentially internally extending groove 194 could be made as individual circular groove segments.

It is obvious that other modifications could be made in the present invention without departing form the basic teachings thereof, in addition to the modification shown in FIG. 18. For example, the insert 112 of the preferred embodiment is shown as having only two sets of grooves flowing toward a center location. It would of course also be possible to provide two or more of such inserts 112 of shorter axial length and position these at endwise abutment in the shell 108. Various other modification could also be made.

What is claimed:

1. A method of processing material in heat transfer relationship, such as a sheet of paper, said method comprising:

a. providing a roll structure mounted for rotation and defining an enclosed chamber to contain a condensable heat transfer medium, said roll structure comprising:

i. a cylindrical side wall having a longitudinal center axis, an outside generally cylindrical contact surface to engage said material in heat transfer relationship and an inside generally cylindrical surface which is exposed to the heat exchange medium in said chamber in heat exchange relationship whereby the medium condenses on the inside surface and heat is conducted through the side wall to the outside surface, said inside generally cylindrical surface having a radial depth dimension at a radial surface distance from said longitudinal center axis;

ii. first and second end walls at first and second ends of said side walls, respectively;

b. providing the inside surface of the side wall with a plurality of longitudinally spaced circumferentially extending grooves, each of which as a substantial circumferentially aligned path component and which extends generally circumferentially along the inside surface of the side wall, said circumferentially extending grooves each having a radial circumferential groove distance to a bottom groove portion of each groove greater than said radial surface distance;

c. providing the inside surface of the side wall with a plurality of circumferentially spaced, longitudinally aligned collecting grooves, spaced around the circumference of the inside surface of the side wall, each of said longitudinally aligned collecting grooves having a radial longitudinal groove distance to a bottom surface of each of said longitudinally aligned collecting grooves at least as great as said radial circumferential groove distance;

d. providing said inside surface of said side wall having a circumferential collecting area having a radial collecting area distance sufficiently great to receive flow from said longitudinally aligned grooves;

e. directing a condensable heat exchange medium into said chamber in heat exchange relationship with said inside surface, in a manner that the medium condenses on the inside surface to form condensate, said circumferential grooves, said longitudinal grooves, and said collecting area thus being arranged so that condensate forming on said inside surface is able to follow a flow path into said circumferential grooves, then into adjacent longitudinal collecting grooves and to said collecting area;

f. collecting the condensate from the collecting area and directing the condensate from the chamber through a chamber outlet;

g. placing said material in contact with the roll and rotating the roll.

2. The method as recited in claim 1, wherein the radial longitudinal groove distance is greater than said radial circumferential groove distance, in a manner that flow from of said circumferentially extending grooves into an adjacent one of said longitudinally aligned collecting grooves moves further from said longitudinal center axis.

3. The method as recited in claim 2, wherein said radial collecting area distance is greater than said radial longitudinally aligned groove distance, whereby flow from said longitudinally aligned collecting grooves moves further from said longitudinal axis into said collecting area.

4. The method as recited in claim 1, wherein said radial collecting area distance is greater than said radial longitudinally aligned groove distance, whereby flow from said longitudinally aligned collecting grooves moves further from said longitudinal axis into said collecting area.

5. The method as recited in claim 1, wherein said collecting area comprises a surface region extending continuously in a 360° curve around the inner surface of the side wall, and said condensate collecting means comprises a tubular member having an inlet position adjacent to said recessed region.

6. The method as recited in claim 1, wherein said side wall comprises an outer cylindrical shell, and at least one generally cylindrical insert positioned in heat transfer contact with said shell, said circumferentially aligned and longitudinally aligned grooves being formed at an inside surface of said insert.

7. The method as recited in claim 6, wherein said insert is made as two insert sections, each having a set of longitudinally aligned and grooves and circumferentially aligned grooves.

8. The method as recited in claim 1, wherein said roll structure is a corrugating roll having at the outer surface a plurality of longitudinally extending ridges separated by recesses.

9. The method as recited in claim 1, wherein said circumferentially aligned grooves are arranged in sets of grooves, with each set being aligned in a substantial 360° curve around said inside surface.

10. A roll assembly to engage a material to be processed in heat transfer relationship, such as a sheet of paper, said roll assembly comprising:

a. a roll structure mounted for rotation and defining an enclosed chamber to contain a condensable heat transfer medium, said roll structure comprising:

i. a cylindrical side wall having a longitudinal center axis, an outside generally cylindrical contact surface to engage said material in heat transfer relationship and an inside generally cylindrical surface which is exposed to the heat exchange medium in said chamber in heat exchange relationship whereby the medium condenses on the inside surface and heat is conducted through the side wall to the outside surface, said inside generally cylindrical surface having a radial depth dimension at a radial surface distance from said longitudinal center axis;

ii. first and second end walls at first and second ends of said side walls, respectively;

b. the inside surface of the side wall being formed with a plurality of longitudinally spaced circumferentially extending grooves, each of which as a substantial circumferentially aligned path component and which extends generally circumferentially along the inside surface of the side wall, said circumferentially extending grooves each having a radial circumferential groove distance to a bottom groove portion of each groove greater than said radial surface distance;

c. the inside surface of the side wall also being formed with a plurality of circumferentially spaced, longitudinally aligned collecting grooves, spaced around the circumference of the inside surface of the side wall, each of said longitudinally aligned collecting grooves having a radial longitudinal groove distance to a bottom surface of each of said longitudinally aligned collecting grooves at least as great as said radial circumferential groove distance;

d. said inside surface of said side wall having a circumferential collecting area having a radial collecting area distance sufficiently great to receive flow from said longitudinally aligned grooves;

e. said circumferential grooves, said longitudinal grooves; and said collecting area thus being arranged so that condensate forming on said inside surface is able to follow a flow path into said circumferential grooves, then into adjacent longitudinal collecting grooves and to said collecting area;

f. condensate collecting means to collect the condensate from the collecting area;

g. chamber inlet means through which said medium passes into said chamber and chamber outlet means through which condensate of said medium passes from said chamber.

11. The roll assembly as recited in claim 10, wherein the radial longitudinal groove distance is greater than said radial circumferential groove distance, in a manner that flow from of said circumferentially extending grooves into an adjacent one of said longitudinally aligned collecting grooves moves further from said longitudinal center axis.

12. The roll assembly as recited in claim 11, wherein said radial collecting area distance is greater than said radial longitudinally aligned groove distance, whereby flow from said longitudinally aligned collecting grooves moves further from said longitudinal axis into said collecting area.

13. The roll assembly as recited in claim 10, wherein said radial collecting area distance is greater than said radial longitudinally aligned groove distance, whereby flow from said longitudinally aligned collecting grooves moves further from said longitudinal axis into said collecting area.

14. The roll assembly as recited in claim 10, wherein said collecting area comprises a surface region extending continuously in a 360° curve around the inner surface of the side wall, and said condensate collecting means comprises a tubular member having an inlet position adjacent to said recessed region.

15. The assembly as recited in claim 10, wherein said side wall comprises an outer cylindrical shell, and at least one generally cylindrical insert positioned in heat transfer contact with said shell, said circumferentially aligned and longitudinally aligned grooves being formed at an inside surface of said insert.

16. The assembly as recited in claim 15, wherein said insert is made as two insert sections, each having a set of longitudinally aligned and grooves and circumferentially aligned grooves.

17. The assembly as recited in claim 10, wherein said roll structure is a corrugating roll having at the outer surface a plurality of longitudinally extending ridges separated by recesses.

18. The assembly as recited in claim 10, wherein said circumferentially aligned grooves are arranged in sets of grooves, with each set being aligned in a substantial 360° curve around said inside surface.

19. The assembly as recited in claim 18, wherein said circumferentially aligned grooves are arranged in at least one substantially continuous helix at the inside surface of the side wall.

20. The assembly as recited in claim 8, wherein said circumferentially aligned grooves are arranged in at least one substantially continuous helix at the inside surface of the side wall.

21. A roll assembly to engage a material to be processed in heat transfer relationship, such as a sheet of paper, said roll assembly comprising:

a. a roll structure mounted for rotation and defining an enclosed chamber to contain a condensable heat transfer medium, said roll structure comprising:

i. a cylindrical side wall having an outside generally cylindrical contact surface to engage said material in heat transfer relationship and an inside generally cylindrical surface which is exposed to the heat exchange medium in said chamber in heat exchange relationship whereby the medium condenses on the inside surface and heat is conducted through the side wall to the outside surfaces;

ii. first and second end walls at first and second ends of said side walls respectively;

iii. said roll structure having a longitudinal center axis about which said roll structure rotates;

b. the inside surface of the side wall being formed with a plurality of elongate grooves to receive condensate that condenses from said medium on said inner surface and provide flow paths for said condensate, said inside surface further providing a collecting location in communication with said grooves to receive the flow of the condensate along the flow paths;

c. said flow paths each having an upstream flow path portion and a downstream flow path portion into which condensate flows from its related upstream flow path portion, said upstream flow path portions being closer to said longitudinal axis than said downstream flow paths portions, said downstream flow path portions leading into said collecting location at a plurality of downstream flow exit locations positioned at circumferentially spaced locations around said collecting location;

d. condensate collecting means to collect the condensate from the collecting location;

e. chamber inlet means through which said medium passes into said chamber and chamber outlet means through which condensate of said medium passes from said chamber.

22. The assembly as recited in claim 21, wherein said collecting location comprises a collecting surface region which extends continuously in a 360° curve around said inside cylindrical surface of the roll structure.

23. The assembly as recited in claim 22, wherein said collecting surface is spaced further from said longitudinal axis than said downstream flow path portions.

24. The assembly as recited in claim 23, wherein said downstream flow path portions are substantially parallel to said longitudinal center axis.

25. The assembly as recited in claim 24, wherein at least a portion of said upstream portions have a substantial circumferential alignment component and are longitudinally spaced along the inside surface.

26. The assembly as recited in claim 21, wherein said downstream flow path portions are substantially parallel to said longitudinal center axis.

27. The assembly as recited in claim 26, wherein at least a portion of said upstream portions have a substantial circumferential alignment component and are longitudinally spaced along the inside surface.

28. The assembly as recited in claim 22, wherein said condensate collecting means comprises a tubular member which remains stationary in said roll structure and has an inlet position adjacent to said recess region at a lower location thereof.

29. The assembly as recited in claim 21, wherein said downstream flow path portions are substantially parallel to said longitudinal center axis, said upstream grooves extend circumferentially entirely around said inside surface, and being spaced longitudinally over said inside surface.

30. The assembly as recited in claim 29, wherein said upstream portions are arranged in a substantial helix.

31. A method of processing a material in heat transfer relationship, such as a sheet of paper, said method comprising:

a. providing a roll structure mounted for rotation and defining an enclosed chamber, said roll structure comprising:

i. a cylindrical side wall having an outside generally cylindrical contact surface inside general cylindrical surface;

ii. first and second end walls at first and second ends of said side walls, respectively;

iii. said roll structure having a longitudinal center axis about which said roll structure rotates;

b. forming the inside surface of the side wall with a plurality of elongate grooves defining a plurality of flow paths, said flow paths each having an upstream flow path portion and a downstream flow path portion into which condensate flows from its related upstream flow path portion, said upstream flow path portions being closer to said longitudinal axis than said downstream flow path portions, said downstream flow path portions leading into said collection location at a plurality of downstream flow exit locations positioned past circumferentially spaced locations around said collecting location;

c. directing a condensable heat exchange medium into said chamber in heat exchange relationship with said inside surface, in a manner that the medium condenses on the inside surface to form condensate and heat in conducted through the side wall to the outside surface, with the grooves receiving the condensate that condenses from said medium on said inner surface and directing the condensate in flow paths for said condensate to a collecting location in the chamber;

d. collecting the condensate from the collecting location and directing the condensate from said chamber through chamber outlet;

e. placing said material in contact with said roll, and rotating said roll as the medium is condensing in the chamber.

32. The method as recited in claim 31, wherein said collecting location comprises a collecting surface region which extends continuously in a 360° curve around said inside cylindrical surface of the roll structure.

33. The method as recited in claim 32, wherein said collecting surface is spaced further from said longitudinal axis than said downstream flow path portions.

34. The method as recited in claim 33, wherein said downstream flow path portions are substantially parallel to said longitudinal center axis.

35. The method as recited in claim 34, wherein at least a portion of said upstream portions have a substantial circumferential alignment component and are longitudinally spaced along the inside surface.

36. The method as recited in claim 31, wherein said downstream flow path portions are substantially parallel to said longitudinal center axis.

37. The method as recited in claim 36, wherein at least a portion of said upstream portions have a substantial circumferential alignment components and are longitudinally spaced along the inside surface.

38. The method as recited in claim 32, wherein said condensate collecting means comprises a tubular member which remains stationary in said roll structure and has an inlet position adjacent to said recess region at a lower location thereof.

39. The method as recited in claim 31, wherein said downstream flow path portions are substantially parallel to said longitudinal center axis, said upstream grooves extend circumferentially entirely around said inside surface, and being spaced longitudinally over said inside surface.

40. The method as recited in claim 39, wherein said upstream portions are arranged in a substantial helix.

* * * * *